US005543905A

United States Patent [19]

Oda et al.

[11] Patent Number: 5,543,905

[45] **Date of Patent: *Aug. 6, 1996**

[54] TONER FIXING DEVICE FOR IMAGE FORMING APPARATUS

[75] Inventors: Katsunari Oda; Akiyoshi Kamisaki; Norimasa Kubota, all of Machida; Teruo Narikawa, Tokyo, all of Japan

[73] Assignee: Minolta Camera Kabushiki Kaisha, Osaka, Japan

[ * ] Notice: The term of this patent shall not extend beyond the expiration date of Pat. No. 5,303,016.

[21] Appl. No.: 439,461

[22] Filed: May 11, 1995

Related U.S. Application Data

[63] Continuation of Ser. No. 964,018, Oct. 20, 1992, abandoned.

[30] Foreign Application Priority Data

Oct. 22, 1991 [JP] Japan ..... 3-302509
Jul. 30, 1992 [JP] Japan ..... 4-223358

[51] Int. Cl.[6] ..... G03G 15/20

[52] U.S. Cl. ..... 355/285; 219/216

[58] Field of Search ..... 355/282, 285, 355/290, 295; 219/216, 469–471; 430/110, 111, 97–99; 432/60

[56] References Cited

U.S. PATENT DOCUMENTS

| | | | |
|---|---|---|---|
| 4,132,882 | 1/1979 | Endo et al. | 219/216 |
| 4,163,892 | 8/1979 | Komatsu et al. | 219/216 |
| 4,266,115 | 5/1981 | Dannatt | 219/216 |
| 4,395,109 | 7/1983 | Nakajima et al. | 219/216 X |
| 4,702,964 | 10/1987 | Hirano et al. | 430/110 X |
| 4,714,819 | 12/1987 | Yamashita | 219/471 X |
| 4,819,020 | 4/1989 | Matsushiro et al. | 219/216 X |
| 5,026,276 | 6/1991 | Hirabayashi et al. | 432/59 |
| 5,032,874 | 7/1991 | Matsuuchi | 355/285 |
| 5,074,019 | 12/1991 | Link | 219/470 X |
| 5,115,279 | 5/1992 | Nishikawa et al. | 355/290 |
| 5,124,755 | 6/1992 | Hediger | 355/285 |
| 5,148,226 | 9/1992 | Setoriyama et al. | 355/290 |
| 5,164,782 | 11/1992 | Nagayama et al. | 355/285 |
| 5,166,031 | 11/1992 | Badesha et al. | 355/285 X |
| 5,171,969 | 12/1992 | Nishimura et al. | 355/285 X |
| 5,173,736 | 12/1992 | Cherian | 355/285 |
| 5,196,895 | 3/1993 | Setoriyama et al. | 355/285 |
| 5,210,579 | 5/1993 | Setoriyama et al. | 355/285 |
| 5,303,016 | 4/1994 | Oda et al. | 219/216 X |

FOREIGN PATENT DOCUMENTS

| | | | |
|---|---|---|---|
| 0295901 | 12/1988 | European Pat. Off. . | |
| 0372479 | 6/1990 | European Pat. Off. . | |
| 0411852 | 2/1991 | European Pat. Off. . | |
| 63-89882 | 4/1988 | Japan . | |
| 5-210327 | 8/1993 | Japan | 355/290 |
| 6-043775 | 2/1994 | Japan | 355/290 |
| 6-075493 | 3/1994 | Japan | 355/290 |

OTHER PUBLICATIONS

"HARD ROLL FUSER"*Xerox Disclosure Journal*, vol. 1, No. 6, Jun. 1976.

*Primary Examiner*—Arthur T. Grimley
*Assistant Examiner*—Shuk Y. Lee
*Attorney, Agent, or Firm*—Brinks Hofer Gilson & Lione

[57] ABSTRACT

A fixing device has a hollow fixing roller, and a pressing roller pressingly contacting the fixing roller to cooperate with the fixing roller to form a nip portion therebetween so as to fuse and fix a toner image onto a recording paper. The fixing device also has a heating element arranged within the fixing roller at a position eccentric from the axis of the fixing roller toward the nip portion, to locally heat the inner wall of the fixing roller at a position corresponding to the nip portion, so as to decrease the time necessary to heat the fixing roller, to prevent offset, and to prevent the recording paper from being wound onto the fixing roller.

5 Claims, 11 Drawing Sheets

TONER FIXING DEVICE FOR IMAGE FORMING APPARATUS

This application is a continuation of application Ser. No. 07/964,018, filed Oct. 20, 1992, now abandoned.

BACKGROUND OF THE INVENTION

1. Field of the Invention

The present invention relates generally to a fixing device for an image forming apparatus, such as an electrophotographic copying machine and a laser-beam printer. More specifically, the invention relates to a fixing device for fusing and fixing a toner image to a sheet by heat and pressure.

2. Description of the Prior Art

Conventionally, image forming apparatuses, such as copying machines and laser-beam printers, are provided with a fixing device for fixing to a sheet a toner image transferred thereto. Such a fixing device comprises, for example, a fixing roller for fusing a toner on a sheet by heat, and a pressing roller for pressing the sheet against the fixing roller so as to nip the sheet therebetween. The fixing roller is cylindrical, and has a heating element which extends along the central axis of the fixing roller and which is retained therein by retaining means. The heating element is composed of, for example, a halogen lamp or the like which generates heat when a given voltage is applied thereto. Since this heating element is positioned at the central axis of the fixing roller, the heat generated by the heating element is evenly radiated to the inner wall of the fixing roller, so that the temperature distribution of the outer wall of the fixing roller is even in the circumferential direction thereof. The outer wall of the fixing roller is heated until the temperature thereof reaches a temperature suitable for fixing, for example, 150° to 200 ° C. In this condition, the fixing roller and the pressing roller rotate in the reverse directions so as to nip therebetween a sheet to which a toner has been adhered. At a contact portion where the fixing roller contacts the pressing roller, which will be hereinafter referred to as a "nip portion", the toner on the sheet is fused by the heat of the fixing roller and is fixed thereto. After fixing, the sheet is carried to a paper discharging roller by the rotations of the fixing roller and the pressing roller, and is discharged to a paper discharge tray by means of the paper discharging roller.

However, in conventional fixing devices, a lot of time is necessary for the temperature of the fixing roller to reach a temperature suitable for fixing after electric power of the apparatus, such as a laser-beam printer, has been turned on. Therefore, there is the disadvantage in that the operator can not use the apparatus for the aforementioned time, and must wait for a long time.

In this case, it is possible to decrease the time necessary to heat the fixing roller by increasing the temperature of the heating element. However, there is another disadvantage in that the demand current of the heating element increases, so that the temperature within the apparatus also increases.

Since the heating element evenly heats the inner wall of the fixing roller so that the temperature of the nip portion is the same as those of portions surrounding the nip portion, there is also the following disadvantages when the sheet is removed from the nip portion in accordance with the rotation of the fixing roller.

That is, since the toner on the sheet is not adhered and remains fused due to the heat of the fixing roller at the surrounding portion, it is difficult for the sheet to be removed from the surrounding portion other than the nip portions of the fixing roller. Consequently, there is the disadvantage in that the sheet is wound onto the fixing roller and causes jamming.

SUMMARY OF THE INVENTION

It is therefore a principal object of the present invention to eliminate the aforementioned disadvantages, and to provide a fixing device which can decrease the time necessary to heat a fixing roller.

It is another object of the present invention to provide a fixing device which can prevent a so-called offset, and prevent a sheet from being wound onto the fixing roller.

In order to accomplish the aforementioned and other objects, a fixing device, according to the present invention, includes a heating element which is arranged within a fixing roller at a position eccentric from the rotational axis of the fixing roller toward a nip portion formed between the fixing roller and a pressing roller, so as to locally heat the inner wall of the fixing roller at a position corresponding to the nip portion.

BRIEF DESCRIPTION OF THE DRAWINGS

The present invention will be understood more fully from the detailed description given herebelow and from the accompanying drawings of the preferred embodiments of the invention. However, the drawings are not intended to imply any limitation of the invention to a specific embodiment, but are for explanation and understanding only.

In the drawings.

DESCRIPTION OF THE PREFERRED EMBODIMENT

Figure 1:
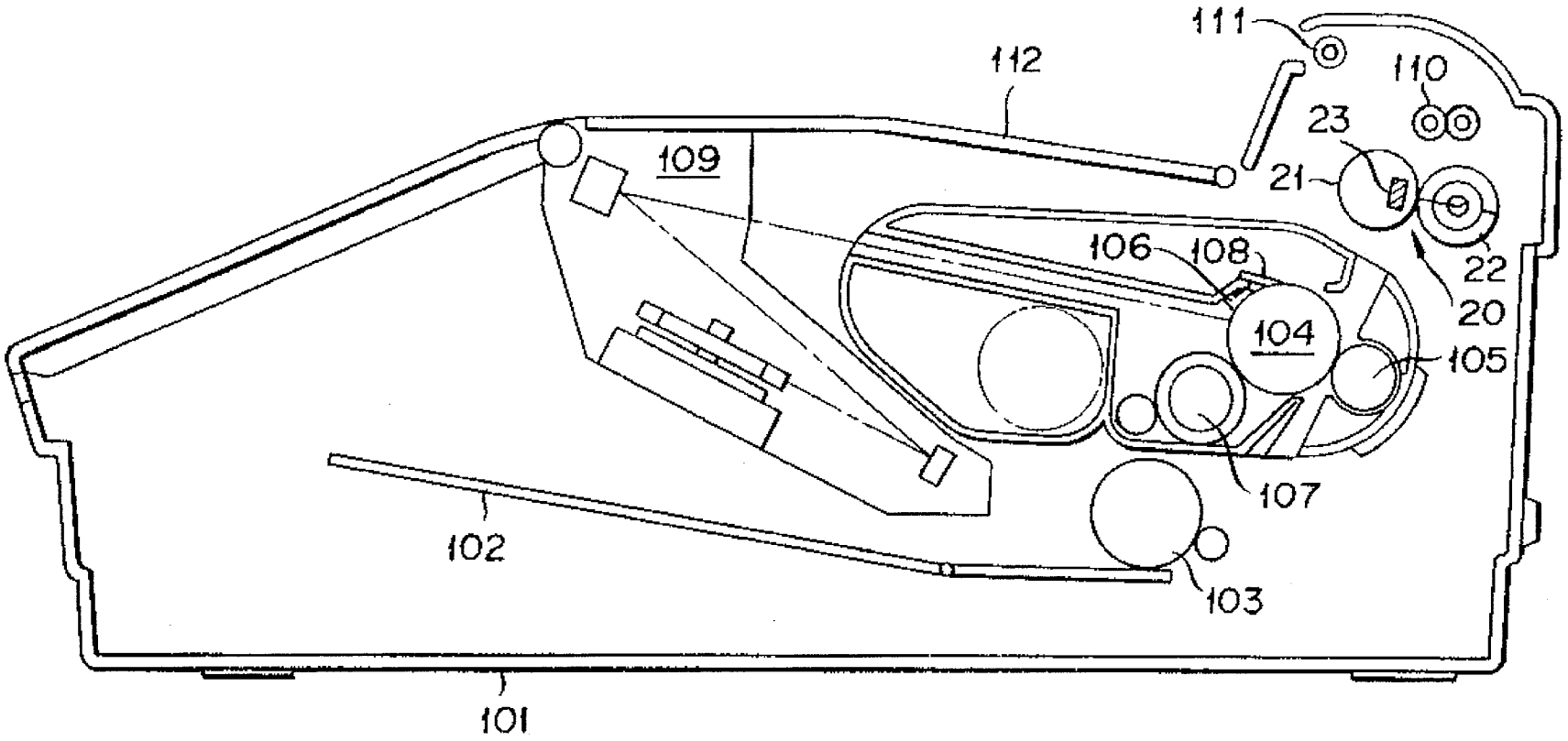
FIG. 1 is a schematic sectional view of a laser-beam printer using the preferred embodiments of a fixing device, according to the present invention.

Referring now to the drawings, particularly to FIG. 1, a laser-beam printer using the preferred embodiments of a fixing device for an image forming apparatus, according to the present invention, will be described below.

A paper feeding tray 102 for storing sheets thereon is provided in a casing 101 of the laser-beam printer. In the vicinity of the paper feeding tray 102, a paper feeding roller 103 is arranged to carry the sheet from the paper feeding tray 102 to a nip portion formed between a photosensitive drum 104 and a transferring roller 105.

The photosensitive drum 104 and the transferring roller 105 are rotatably supported on a frame of the laser-beam printer. The transferring roller 105 is kept in contact with the photosensitive drum 104 to cooperate therewith to form the nip portion therebetween. In the vicinity of the photosensitive drum 104, a charging brush 106 for causing electrostatic charge on the surface of the photosensitive drum 104 is arranged. The laser-beam printer is provided with an optical unit 109 which radiates a laser beam onto the surface of the photosensitive drum 104 via a slit to form an electrostatic latent image thereon. In the vicinity of the photosensitive drum 104, a developing device 107 is also arranged. The developing device 107 serves to cause a toner to adhere to the electrostatic latent image, to form a toner image on the surface of the photosensitive drum 104. The transferring roller 105 serves to form a given electric field between the transferring roller 105 and the photosensitive drum 104 and to transfer the toner image to the sheet on the photosensitive drum 104. Furthermore, a blade 108 is arranged so as to contact the photosensitive drum 104 to rake or clean the residual toner thereon.

Above the photosensitive drum 104, a fixing device 20 is arranged. The fixing device 20 comprises a fixing roller 21 with a built-in heating element 23, and a pressing roller 22 for pressing a sheet against the fixing roller 21. Above the fixing device 20, a carrying roller 110 and a paper discharging roller 11 are arranged to discharge the sheet to a paper discharge tray 112.

Figure 2:
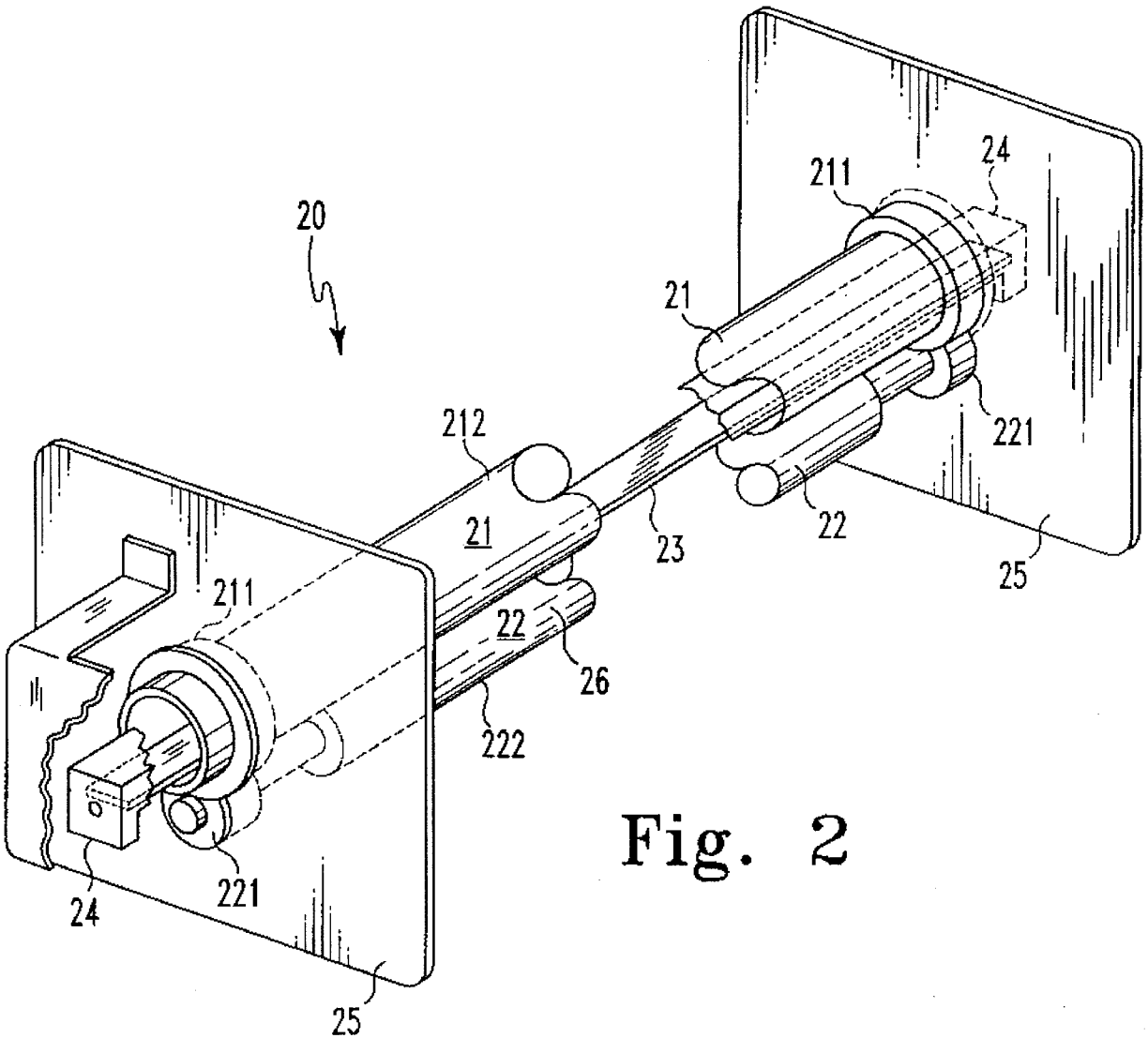
FIG. 2 is a partially-broken, perspective view of the first preferred embodiment of a fixing device, according to the present invention.
Figure 3:
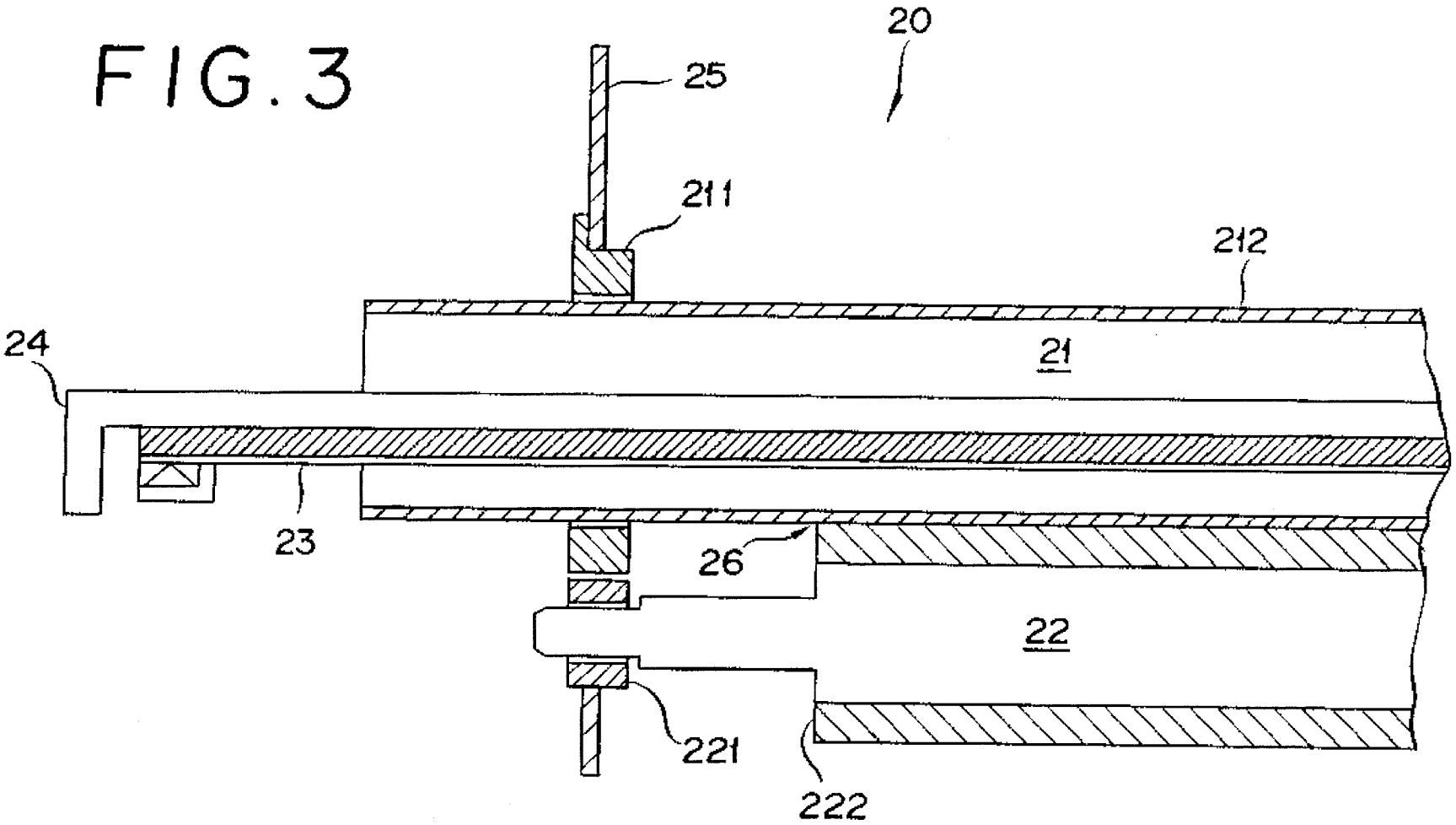
FIG. 3 is a sectional view of the fixing device of FIG. 2.
Figure 4:
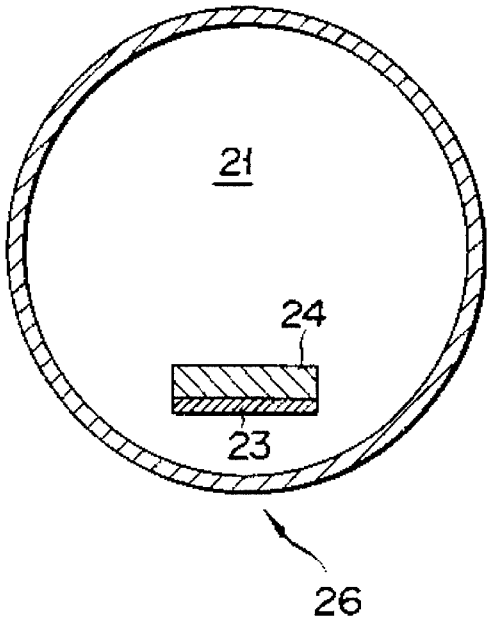
FIG. 4 is a view of a heating portion in the first preferred embodiment of an fixing device, according to the present invention.

Referring to FIGS. 2 to 4, the first preferred embodiment of a fixing device, according to the present invention, will be described below.

FIG. 2 is a partially-broken, perspective view of the first preferred embodiment of a fixing device 20, according to the present invention, FIG. 3 is a sectional view of the fixing device 20 of FIG. 2, and FIG. 4 is a sectional view showing the fixing roller 21, the heating element 23 and so forth in the fixing device 20 of FIG. 2.

A pair of frames 25 are secured to the casing 101 of the laser-beam printer so as to be opposite to each other (only one frame is shown in FIGS. 2 and 3). The respective frames 25 are provided with bearings 211 and 221. The fixing roller 21 is rotatably supported on the bearing 211, and the pressing roller 22 is rotatably supported on the bearing 221. The pressing roller 22 is designed to rotate while pressingly contacting the fixing roller 21.

The fixing roller 21 is composed of a thin hollow cylinder. In order to enhance the releasability of the fixing roller 21 from the sheet, and in order to prevent offset, the peripheral surface of the fixing roller 21 is coated with a polyfluoroethylene fiber coating 212. A supporting member 24 of an elongated strip is so arranged as to pass through the fixing roller 21, and both ends thereof are secured to the frames 25. The heating element 23 is composed of an electric-resistant strip having an essentially rectangular cross-section, and is secured to the supporting member 24. As can be seen clearly from FIG. 4, the heating element 23 is positioned eccentric from the rotational axis of the fixing roller 21 toward a nip portion 26 formed between the fixing roller 21 and the pressing roller 22. The pressing roller 22 is also cylindrical, and the peripheral surface thereof is covered with an elastic member 222, such as silicon sponge or rubber.

The operation of the laser-beam printer having the aforementioned constructions will be described below.

First, a sheet stored on the paper feeding tray 102 is carried to the nip portion between the photosensitive drum 104 and the transferring roller 105 by means of the paper feeding roller 103. After a toner is transferred to the sheet at the nip portion, the sheet is carried to the fixing device 20. In this fixing device 20, the sheet is heated by means of the fixing roller 21 while being nipped between the fixing roller 21 and the pressing roller 22, so that the toner on the sheet is fused and fixed to the surface of the sheet. The sheet to which the toner has been fixed is discharged to the paper discharge tray 112 by means of the carrying roller 110 and the paper discharging roller 111.

Next, the operation of the fixing device 20 will be described below.

When electrical power to the laser-beam printer is turned on, a predetermined voltage is applied to the heating element 23, so that it generates heat of a high temperature. According to the present invention, since the heating element 23 is positioned eccentric toward the nip portion 26 of the fixing roller 21, the time necessary for the nip portion 26 of the fixing roller 21 to reach the temperature suitable for fixing (150° to 200 ° C.), is shorter than when the heating element 23 is positioned at the center of the fixing roller 21. In this case, the temperature of the surrounding portion other than the nip portion 26 of the fixing roller 21 is lower than that of the nip portion 26. As the fixing roller 21 rotates so that a portion of the fixing roller 21 corresponding to the nip portion 26 moves away therefrom, the distance between the portion of the fixing roller 21 and the heating element 23 increases. Since the fixing roller 21 is thin and its heat capacity is low, the temperature of the portion of the fixing roller 21 away from the nip portion 26 easily decreases.

The sheet carried to the fixing device 20 is nipped at the contact portion where the fixing roller 21 contacts the pressing roller 22, i.e. at the nip portion 26. Since the pressing roller 22 pressingly contacts the fixing roller 21, the elastic member 22 on the surface of the pressing roller 22 is deformed to increase the area of the contact portion where the fixing roller 21 contacts the pressing roller 22, i.e. the area of the nip portion 26. The flexible sheet contacts not only the nip portion 26, but also the surrounding portion thereof. The toner on the sheet is fused by the heat of the nip portion 26 of the fixing roller 21. As the fixing roller 21 rotates, the portion of the sheet on which the toner has been fused moves away from the nip portion 26 of the fixing roller 21 to a portion neighboring the nip portion 26. At this time, although the sheet contacts the portion neighboring the nip portion 26 of the fixing roller 21, the temperatures of the surrounding portion and the toner fused by heat decrease to a temperature necessary to adhere the toner to the sheet. Therefore, it is possible to prevent the fused toner from adhering to the surface of the fixing roller 21 at the portion neighboring the nip portion 26, that is, to prevent offset.

When the fixing roller 21 further rotates, the sheet is intended to be removed from the portion neighboring the nip portion 26 of the fixing roller 21. At this time, since the toner has been adhered to the sheet, the adhesive strength of the toner has been sufficiently decreased. Therefore, the sheet is easily removed from the fixing roller 21, so that it is possible to prevent the sheet from being wound onto the fixing roller 21 to thereby prevent jamming.

As mentioned above, according to this embodiment, it is possible to decrease the time necessary to heat the fixing roller 21 without increasing the heating value of the heating element 23. Therefore, it becomes possible to prevent the temperature increase within the apparatus such as a laser-beam printer comprising a fixing device of the present invention. And, it is also possible to prevent the demand current of the heating element 23 from increasing. Furthermore, since the toner is fixed to the sheet when the sheet is removed from the fixing roller 21, it is difficult for the toner to adhere to the fixing roller 21, so that it is possible to prevent offset. At this time, since the adhesive strength of the toner on the sheet sufficiently decreases, the sheet is easily removed from the fixing roller 21 to prevent jamming.

Figure 5:
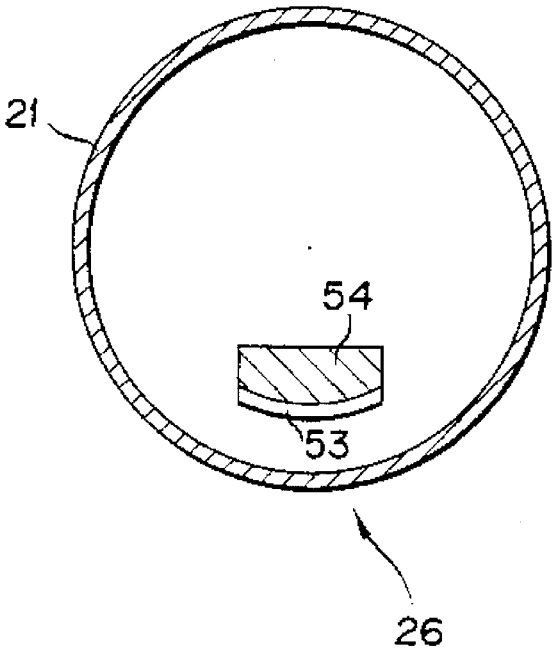
FIG. 5 is a view of a heating portion in the second preferred embodiment of an fixing device, according to the present invention.

FIG. 5 shows a fixing roller 21 in the second preferred embodiment of a fixing device 20, according to the present invention.

In this embodiment, the fixing device 20 is substantially the same as that of the first preferred embodiment, except that a heating element 53 and a supporting member 54 are substituted for the heating element 23 and the supporting member 24, respectively. The heating element has on the opposite side to the nip portion 26 a curved surface which is curved along the inner wall of the fixing roller 21. The curved surface has substantially the same curvature as that of the inner surface of the fixing roller 21, and the center of curvature thereof is also positioned at the same position as that of the inner surface of the fixing roller 21. Therefore, the heat generated by the heating element 53 is uniformly radiated onto the nip portion 26 of the fixing roller 21, so that the nip portion 26 of the fixing roller 21 is evenly heated. The heating element 53 is secured to the supporting member 54 which passes through the fixing roller 21 and which are secured to the frame 25 on both ends thereof.

Figure 6:
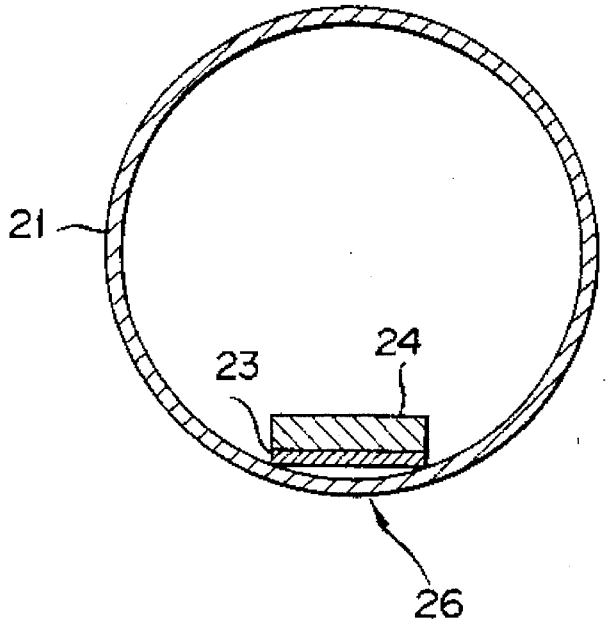
FIG. 6 is a view of a heating portion in the third preferred embodiment of an fixing device, according to the present invention.

FIG. 6 shows a fixing roller 21 in the third preferred embodiment of a fixing device 20, according to the present invention.

In this embodiment, the fixing device 20 is substantially the same as that of the first preferred embodiment, except that the heating element 23 contacts the inner wall of the fixing roller 21. The heat generated by the heating element 23 is directly (through no air layer) transmitted to the inner wall of the fixing roller 21. Therefore, the heat generated by the heating element 23 is efficiently transmitted to the nip portion 26 of the fixing roller 21, so as to decrease the time necessary to heat the portion of the fixing roller 21 contacting the sheet.

Figure 7:
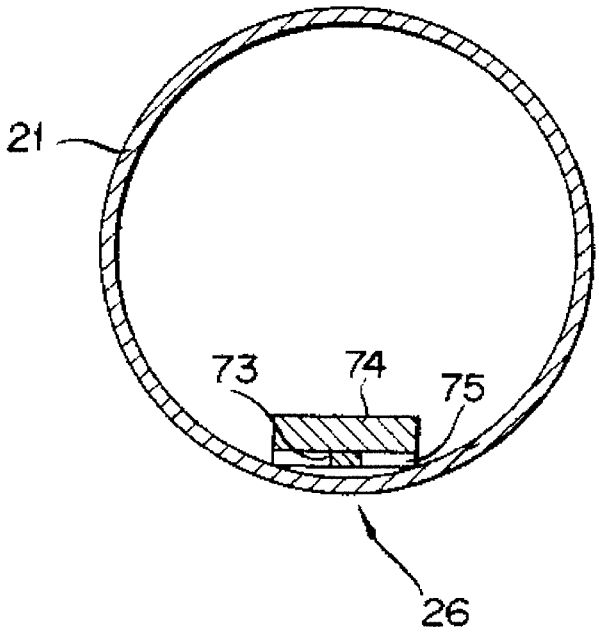
FIG. 7 is a view of a heating portion in the fourth preferred embodiment of an fixing device, according to the present invention.

FIG. 7 shows a fixing roller 21 in the fourth preferred embodiment of a fixing device 20, according to the present invention.

In this embodiment, the fixing device 20 is substantially the same as that of the third preferred embodiment, except that a heating element 73 and a supporting element 74 are respectively substituted for the heating element 23 and the supporting element 24. The heating element 73 is secured to the supporting element 74, and is covered with an abrasion resistant member 75 made of, for example, glass, which is also secured to the supporting element 74. The abrasion resistant member 75 contacts the inner wall of the fixing roller 21, so that the heat generated by the heating element 73 is transmitted to the fixing roller 21 through the abrasion resistant member 75. According to this embodiment, it is possible to prevent the surface of the heating element 73 from abrading due to the friction of the heating element 73 against the inner wall of the fixing roller 21.

Figure 8:
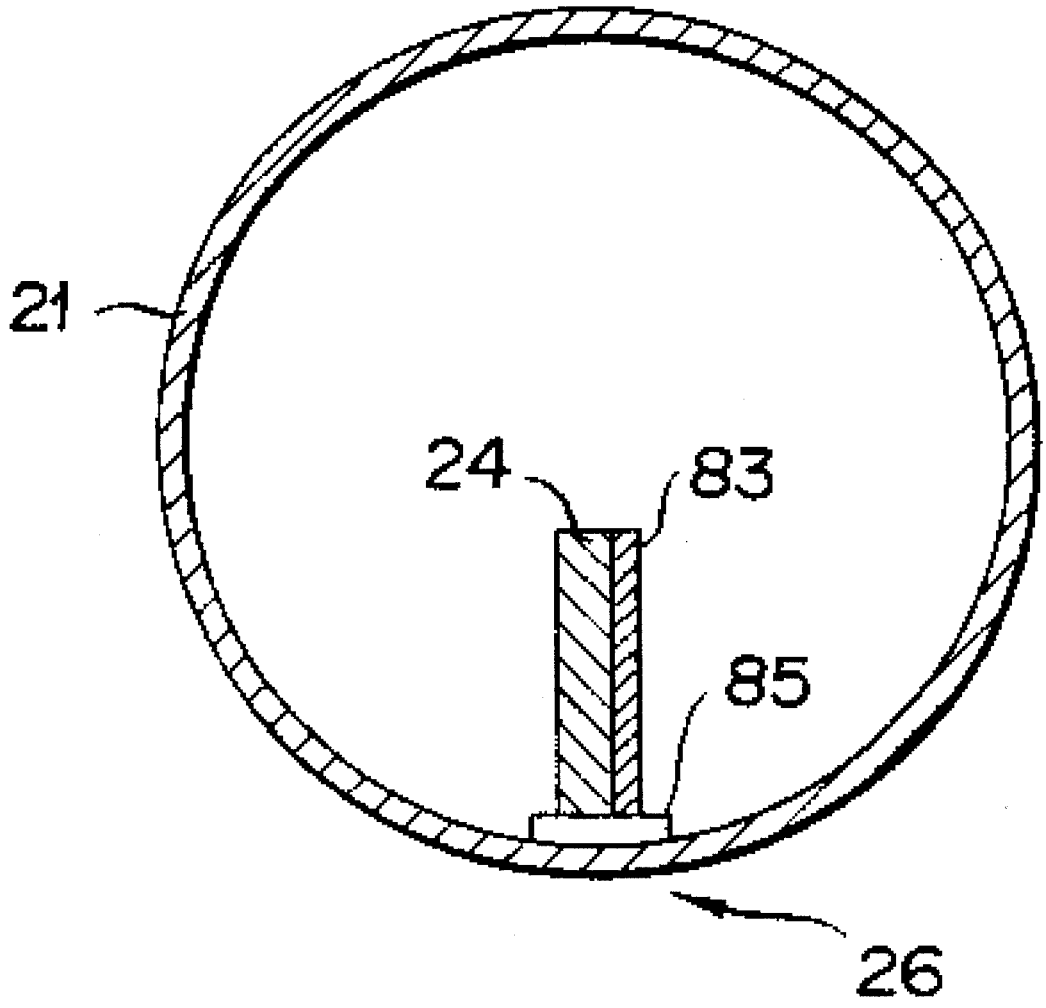
FIG. 8 is a view of a heating portion in the fifth preferred embodiment of an fixing device, according to the present invention.

FIG. 8 shows a fixing roller 21 in the fifth preferred embodiment of a fixing device 20, according to the present invention.

In this embodiment, a heating element 83 is secured to the supporting member 24. The heating element 83 and the supporting member 24 are secured to an abrasion resistant member 85 which contacts the inner wall of the fixing roller 21. The area of the abrasion resistant member 85 contacting the inner wall of the fixing roller 21 is relatively small, so as to sufficiently decrease the temperature of the surrounding portion of the fixing roller 21 other then the nip portion 26. Therefore, it is possible to effectively prevent offset when the sheet is removed from the fixing roller 21, and to allow the sheet to be easily removed from the fixing roller 21.

Next, the materials and operation of the fixing roller 21 in the aforementioned first to fifth preferred embodiment will be described below.

As mentioned above, the inner wall of the fixing roller 21 is heated by the heating element while it rotates. As the fixing roller 21 rotates, the heated portion of the fixing roller 21 moves away from the heating element to radiate heat. That is, each portion of the fixing roller 21 reciprocally repeats heating and radiation in accordance with the rotation thereof.

Figure 9A:
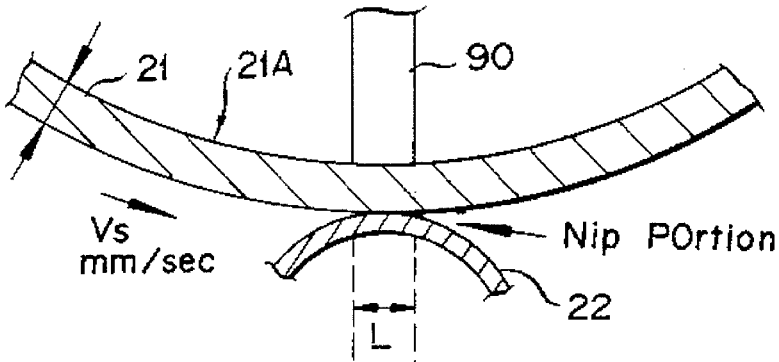
FIGS. 9(A) and 9(B) are views showing the heating time and the cooling time of a fixing roller, according to the present invention.
Figure 9B:
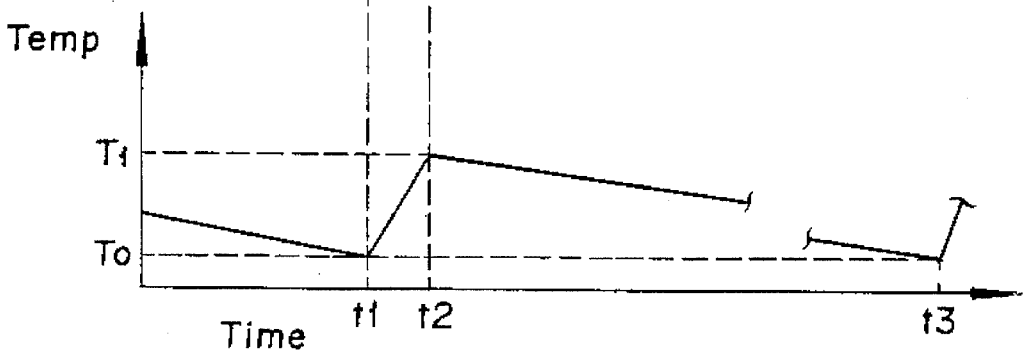

FIGS. 9(A) and 9(B) show the heating time and the cooling time of the fixing roller 21. In FIG. 9(A), the fixing roller 21 rotates counterclockwise, and a heating element 90 slidably contacts the inner wall of the fixing roller 21, the outer wall of which contacts the pressing roller 22. FIG. 9(B) is a graph showing the temperature variation of an inner wall portion 21A of the fixing roller 21.

When the fixing roller 21 rotates, the inner wall portion 21A of the fixing roller 21 moves toward the heating element 90. When the inner wall portion 21A reaches the heating element 90, it receives the heat generated by the heating element 90, so that the temperature thereof increases (time t1 to t2). When the fixing roller 21 further rotates, the inner wall portion 21A moves away from the heating element 90, so that the temperature thereof decreases. Until the inner wall portion 21A reaches a position before the heating element 90 after one cycle of rotation, the temperature thereof decreases to To (time t3).

When the fixing roller 21 is made of a material having a short heating time and a short cooling (radiation) time, there are the following advantages.

That is, when the time taken for the inner wall 21A to reach the necessary temperature T1 for fixing, is short, it is possible to increase the angular velocity of the fixing roller 21, and to decrease the time necessary for the sheet to move on the nip portion. That is, it is possible to increase copying speed (printing speed). In addition, when the cooling time of the fixing roller 21 is sufficiently short, the temperature of the fixing roller 21 decreases quickly after the sheet passes through the nip portion, so as to prevent a so-called high-temperature offset. When the fixing roller 21 is heated quickly, there is also the advantage that it is possible to sufficiently secure the temperature of the fixing roller 21 necessary for fixing even if the thickness $\tau$ of the fixing roller 21 is increased. As a result, it is possible to bring the fixing roller 21 into contact with the pressing roller 22 under a higher pressure by increasing the thickness of the fixing roller 21, so as to securely fix the toner to the sheet.

Therefore, there are the following requirements in the material of the fixing roller 21:

(1) when the fixing roller 21 is heated, the heat is easily transmitted therethrough; and (2) when the fixing roller 21 is not heated, it is cooled quickly.

As materials satisfying these requirements, Mg, Al or the like is preferably used. The reasons thereof will be described below.

First, the heating time of the fixing roller 21 is calculated. In FIG. 9(A), assuming that the travel speed of the inner wall portion 21A of the fixing roller 21 is Vs [mm/sec], and that the length of the nip portion is 1, the time t necessary for the inner wall portion 21A to pass through the nip portion can be expressed by 1/Vs [sec]. Also, the heat capacity CN of the nip portion can be expressed by the following equation.

$$CN=4.19\times10\ \exp(-6)\times CP\tau lVs(T1-T0)\ [J]$$

wherein C and P are respectively a specific heat and a specific gravity. These values vary in accordance with the material of the fixing roller 21. Furthermore, L is a length of the fixing roller 21 in the direction of the axis thereof. Therefore, the quantity of heat applied to the nip portion of the fixing roller 21 per 1 [sec] can be expressed by the following equation.

$$CN\cdot(T1-T0)/t=4.19\times10\ \exp(-6)\times CP\tau LVs\ (T1-T0)\ [J/sec]$$

Furthermore, it is assumed that the temperature distribution of the fixing roller 21 in the thickness direction thereof is even, and that there is no heat conduction in the circumferential direction thereof.

Figure 10:
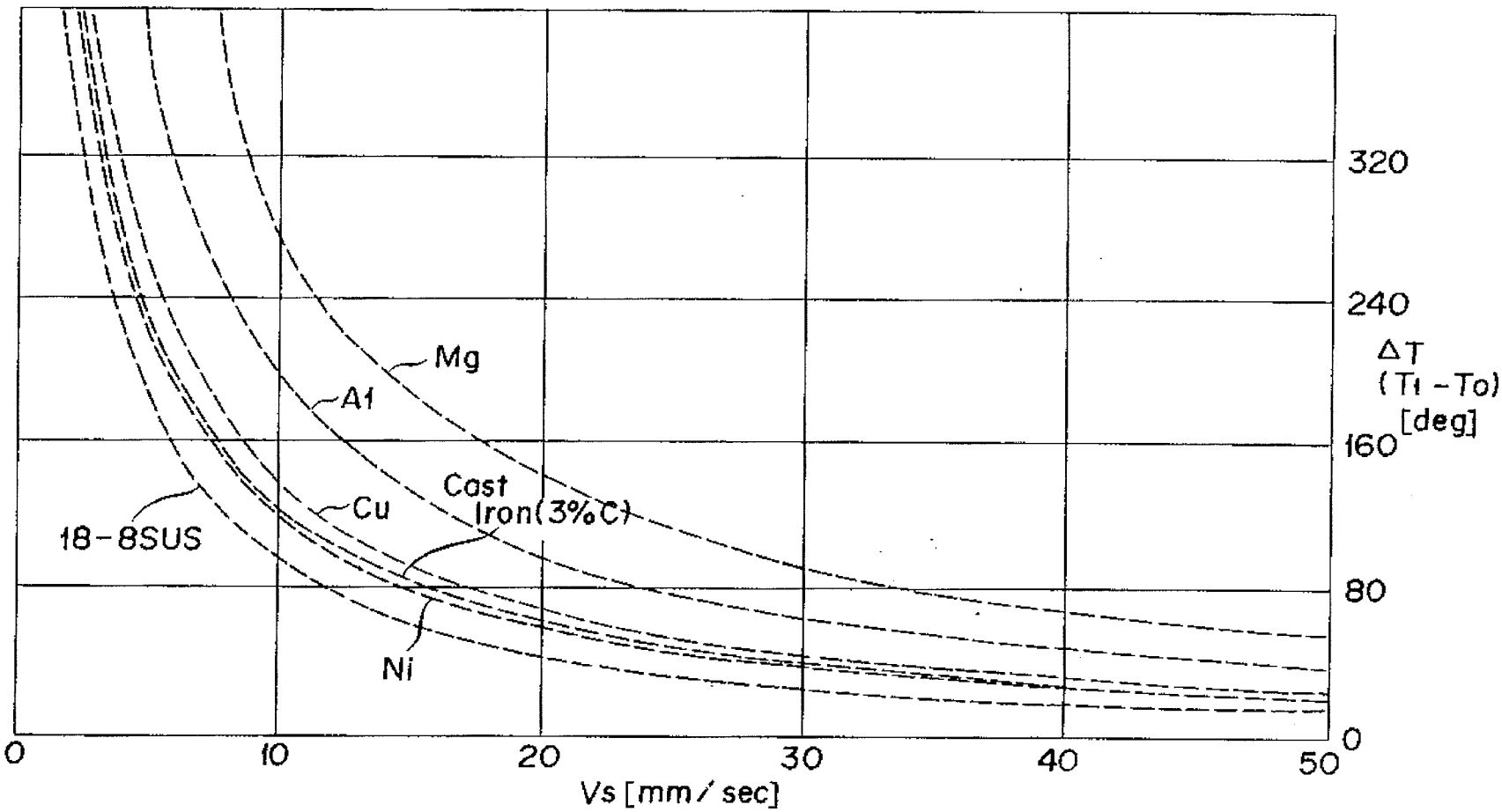
FIG. 10 is a graph showing the heating time of a fixing roller, according to the present invention.
Figure 11:
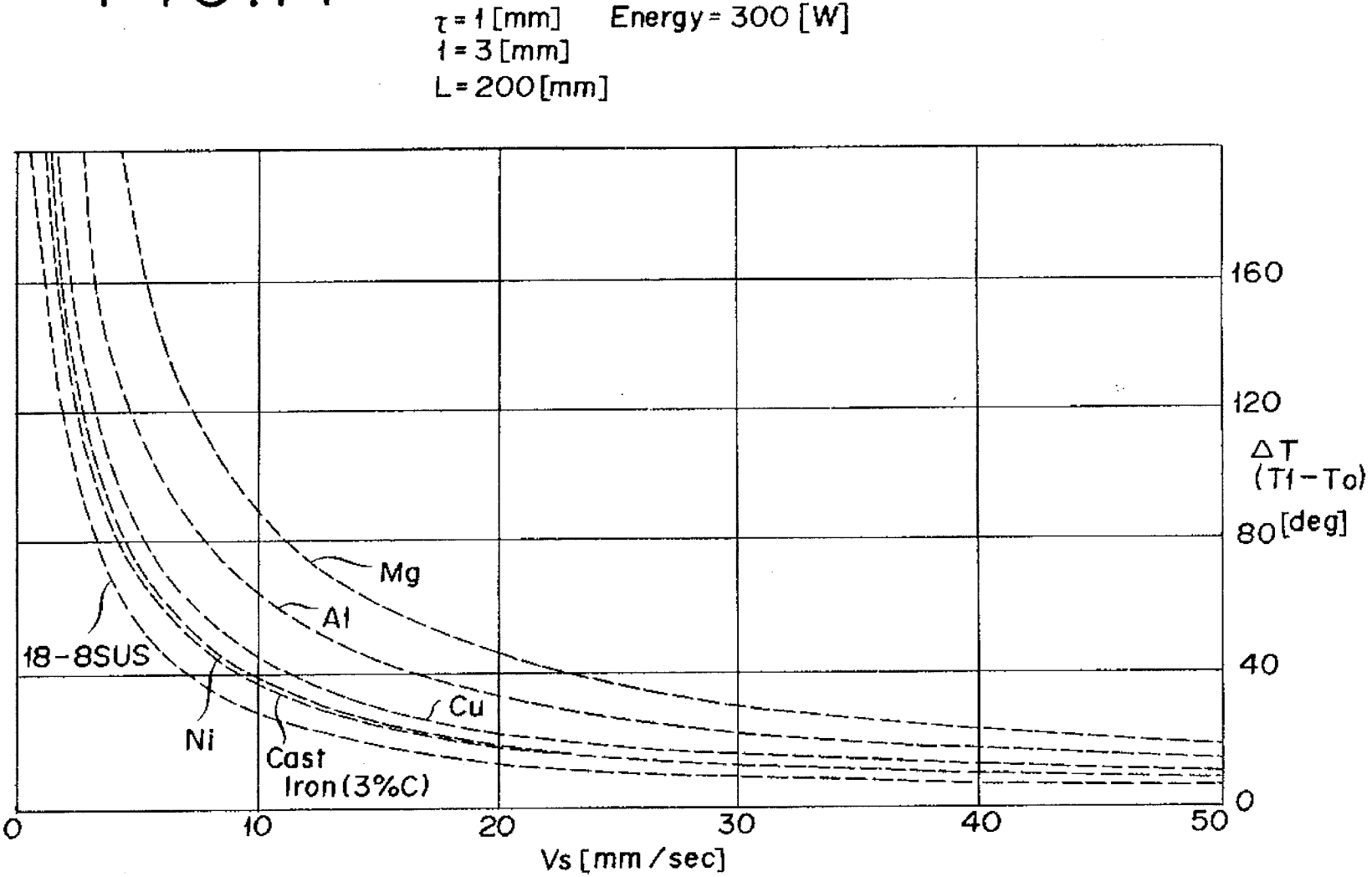
FIG. 11 is a graph showing the heating time of a fixing roller, according to the present invention.
Figure 12:
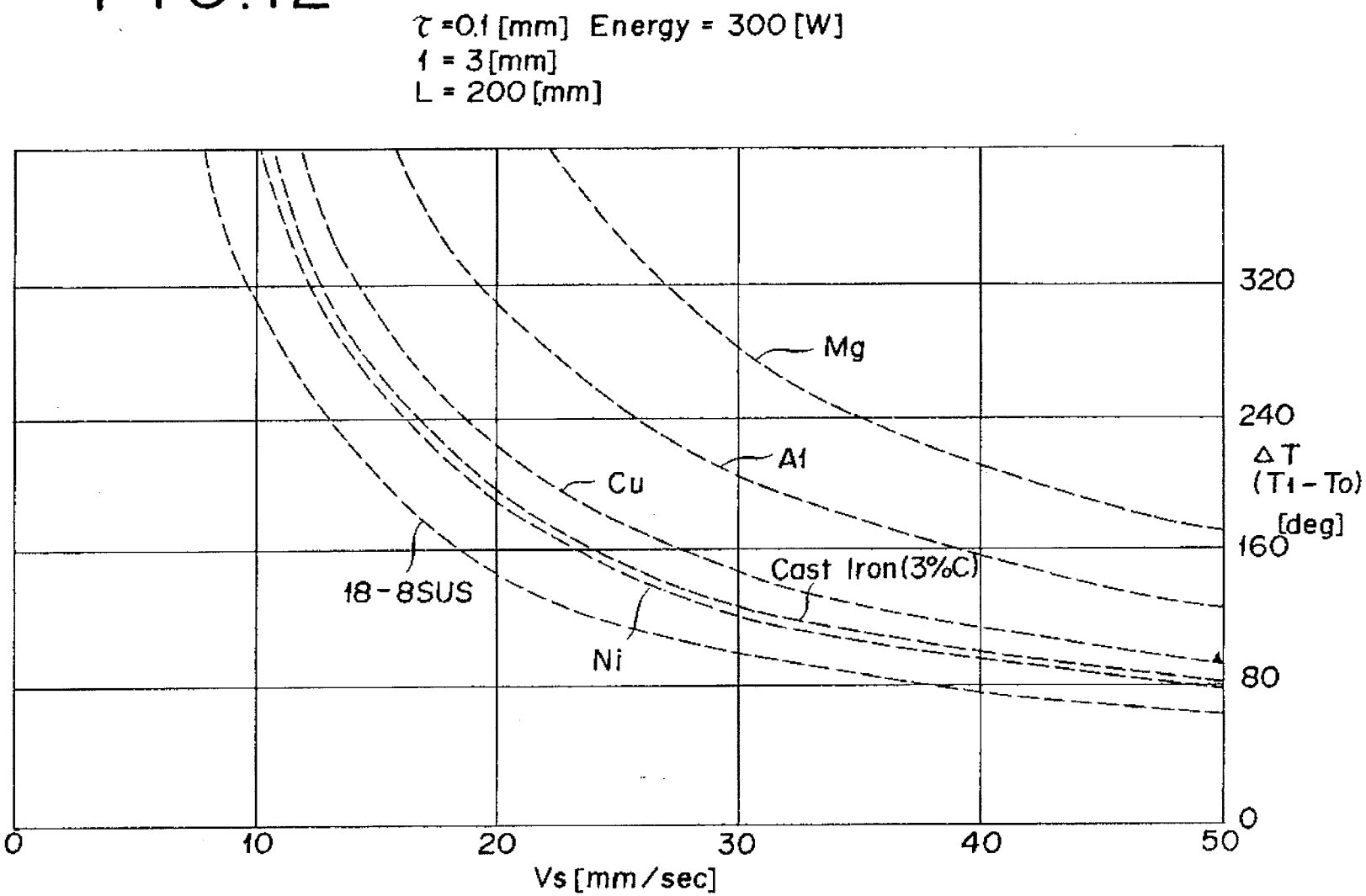
FIG. 12 is a graph showing the heating time of a fixing roller, according to the present invention.

The temperature increases of the fixing roller 21 calculated on the basis of the aforementioned equation are shown in FIG. 10. In this figure, the temperature increases were calculated assuming that $\tau$=0.3 mm, l=3 mm, L=200 mm and the energy applied to the nip portion is 300 W. In this figure, the axis of the abscissa denotes the travel speed Vs of the fixing roller 21, and the axis of the ordinate denotes (T1–T0). By increasing the travel speed Vs, i.e. by causing the fixing roller to rotate at a higher speed, it can be confirmed that the temperature increase of the fixing roller 21 decreases (the heating time increases). However, when magnesium (Mg), aluminum (Al), copper (Cu), nickel (Ni), cast iron (3% C) or the like is used as the material of the fixing roller 21, it is possible to make the temperature increase of the fixing roller 21 to a relatively great. Therefore, when Mg, Al or the like is used as the material of the fixing roller 21, it is possible to decrease the heating time. Furthermore, FIG. 11 is a graph showing the temperature increase of the fixing roller 21 when the thickness $\tau$ of the fixing roller 21 is 1 mm, and FIG. 12 shows a graph showing the temperature increase thereof when it is 0.1 mm.

Next, the cooling time of the fixing roller 21 will be calculated below.

In FIGS. 9(A) and 9(B), after the inner wall portion 21A passes through the heating element 90, and until it reaches directly before the heating element 90 again, the temperature of the inner wall portion 21A decreases from T1 to T0. The period of time t' during this time can be expressed by $(2\pi r-1)/Vs$, wherein r is a radius of the fixing roller. This equation can be approximated by $t'=2\pi r/Vs$. Therefore, assuming that the heat capacity of the nip portion is CN, the quantity of heat radiated while the inner wall portion 21A rotates one cycle can be expressed as follows.

$$CN\cdot(T1-T0)/t'=4.19\times10\ \exp(-6)\times CP\tau LVsl\ (T1-T0)/2\pi r\ [J/sec]$$

Assuming that the quantity of heat radiated is Q, the aforementioned equation can be modified as follows.

$$(T1-T0)=Q/\{4.19\times10\ \exp(-6)\times CP\pi LVsl/2\pi r\}$$

Furthermore, it is assumed that the temperature distribution of the fixing roller 21 in the thickness direction thereof is even, that there is no heat conduction in the circumferential direction thereof, and that the width of the nip portion is far smaller than the whole circumferential length of the fixing roller 21.

Figure 13:
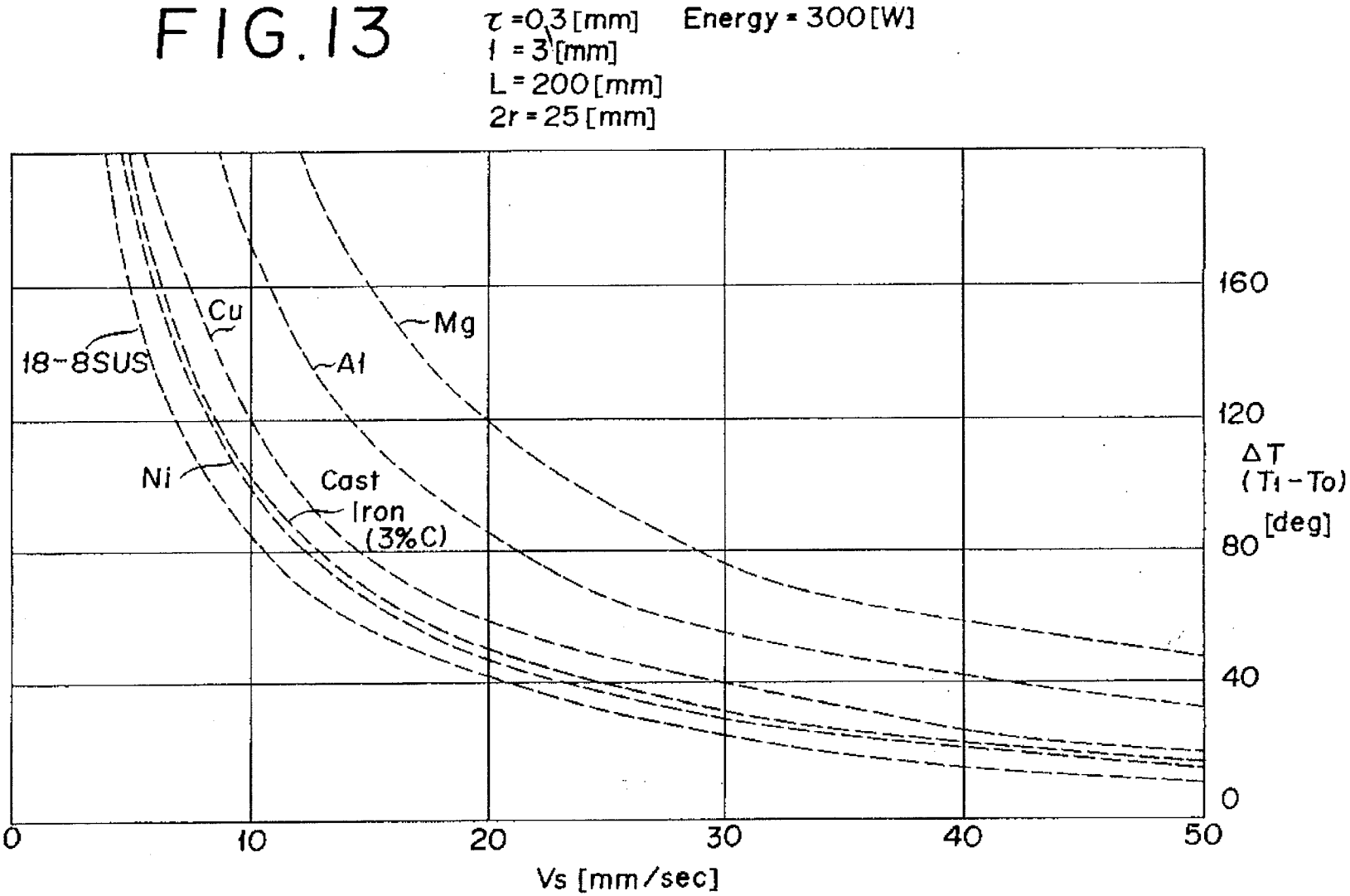
FIG. 13 is a graph showing the cooling time of a fixing roller, according to the present invention.

FIG. 13 is a graph showing the cooling times of the fixing roller 21 calculated on the basis of the aforementioned equation. In this figure, the heating times were calculated assuming that $\tau$=0.3 mm, l=3 mm, L=200 mm, 2r=25 mm, and the energy applied to the nip portion is 300 W. In this figure, the axis of the abscissa denotes the travel speed Vs, and the axis of the ordinate denotes (T1–T0). As can be seen from FIG. 13, when the fixing roller 21 is made of Mg, Al , Cu, Ni, cast iron or the like, it is possible to increase the heat radiating temperature. Therefore, it is possible to decrease the cooling time when the fixing roller 21 is made of Mg, Al, Cu, Ni, cast iron or the like.

Therefore, when the fixing roller 21 is made of Mg, Al, Cu, Ni, cast iron or the like, it is possible to decrease both the heating time and the cooling time of the fixing roller 21. As mentioned above, since the heating time is decreased, it is possible to increase the copying speed (printing speed). In addition, since the cooling time is also decreased, it is possible to securely fix the toner to the sheet by increasing the thickness of the fixing roller 21.

As mentioned above, according to the present invention, there are advantages in that it is possible to decrease the time necessary to heat the fixing roller and to prevent offset, and that it is difficult for the sheet to be wound onto the fixing roller.

Although the present invention has been fully described by way of examples with reference to the accompanying drawings, it is to be noted that various changes and modifications will be apparent to those skilled in the art. Therefore, unless otherwise such changes and modifications depart from the scope of the present invention, they should be construed as being included therein.

What is claimed is:

1. A fixing device comprising:

a hollow fixing roller rotatably supported by frames of the fixing device only at its both ends with respect to a direction of its rotational axis;

a heating element for heating the fixing roller;

pressing means for pressing a recording paper to the fixing roller so as to fuse and fix a toner image onto the recording paper; and supporting means for supporting the heating element inside the fixing roller so that said fixing roller rotates relative to said heating element and the heating element contacts an inner wall of the fixing roller at a position close to where the recording paper pressingly contacts the fixing roller.

2. The fixing device as claimed in claim 1, wherein said heating element includes an abrasion-resistant member so that said heating element contacts the inner wall of the fixing roller by the abrasion-resistant member.

3. A fixing device comprising:

a hollow fixing roller rotatably supported by frames of the fixing device only at its both ends with respect to a direction of its rotational axis;

a pressing roller pressingly contacting the fixing roller to form a nip portion between the fixing roller and the pressing roller for nipping a recording paper;

a heating element for heating the fixing roller so as to fuse and fix toner images onto the recording paper; and supporting means for supporting the heating element fixedly to the frames of the fixing device so that said heating element contacts an inner wall of the fixing roller in the vicinity of the nip portion.

4. The fixing device as claimed in claim 3, wherein said heating element includes an abrasion-resistant member so that said heating element contacts the inner wall of the fixing roller by the abrasion-resistant member.

5. The fixing device as claimed in claim 4, wherein said heating element has a rectangular cross-section, and a shorter side of the rectangular cross-section faces the nip portion.

* * * * *